US008007310B2

(12) United States Patent
Landis et al.

(10) Patent No.: US 8,007,310 B2
(45) Date of Patent: Aug. 30, 2011

(54) INSULATION DISPLACEMENT CRIMP CONNECTOR

(75) Inventors: John Michael Landis, Camp Hill, PA (US); David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 674 days.

(21) Appl. No.: 11/744,303

(22) Filed: May 4, 2007

(65) Prior Publication Data

US 2011/0117794 A1 May 19, 2011

(51) Int. Cl.
*H01R 4/24* (2006.01)

(52) U.S. Cl. ..... 439/404; 439/417

(58) Field of Classification Search ..... 439/404, 439/405, 417, 425

See application file for complete search history.

(56) References Cited

U.S. PATENT DOCUMENTS

| | | | | |
|---|---|---|---|---|
| 4,666,227 | A | 5/1987 | Galizia et al. | |
| 4,758,536 | A | 7/1988 | Miller et al. | |
| 5,242,314 | A * | 9/1993 | Di Giulio et al. | 439/404 |
| 6,416,349 | B1 * | 7/2002 | Lee | 439/404 |
| 6,688,920 | B2 * | 2/2004 | Lehner et al. | 439/748 |
| 6,875,044 | B1 * | 4/2005 | Lee | 439/404 |
| 7,048,563 | B2 * | 5/2006 | Fukuda et al. | 439/276 |
| 7,121,871 | B2 | 10/2006 | Duesterhoeft et al. | |
| 7,156,689 | B2 | 1/2007 | Fabian et al. | |
| 2004/0192103 | A1 * | 9/2004 | Lee | 439/404 |
| 2004/0266250 | A1 | 12/2004 | Muro et al. | |
| 2005/0106927 | A1 * | 5/2005 | Goto et al. | 439/404 |
| 2006/0030200 | A1 * | 2/2006 | Doorhy et al. | 439/404 |
| 2006/0134966 | A1 * | 6/2006 | Lappohn | 439/404 |
| 2006/0172585 | A1 * | 8/2006 | Tashiro et al. | 439/404 |
| 2006/0199423 | A1 | 9/2006 | Yamanashi et al. | |

FOREIGN PATENT DOCUMENTS

| | | |
|---|---|---|
| DE | 10 2004 054 203 | 5/2006 |
| EP | 1 369 956 | 12/2003 |

* cited by examiner

*Primary Examiner* — Hien Vu

(57) ABSTRACT

An electrical connector assembly includes a first connector portion for supporting a plurality of insulated electrical conductors, and a second connector portion removably engageable with the first connector portion. The first connector portion includes a plurality of detent elements to secure the electrical conductors to the first connector portion, and at least one alignment recess. The second connector portion includes socket portions corresponding to the plurality of electrical conductors of the first portion, and an alignment member cooperative with the alignment recess to guide the second connector portion into engagement with the first connector portion. Socket portions include an insulation displacement crimp (IDC) connector portion configured to penetrate a corresponding external insulating layer of a corresponding one of the plurality of electrical conductors to place the IDC connector portion in electrical communication with the conductive core portion of the corresponding electrical conductor.

22 Claims, 6 Drawing Sheets

INSULATION DISPLACEMENT CRIMP CONNECTOR

BACKGROUND

The present invention is directed to electrical connectors and more particularly to connectors for simultaneously tapping into multiple insulated wires.

Electrical connectors are used to connect various forms of components and equipment. For example, some electrical connectors connect printed circuit boards to wires, which are used to convey power to appliances and utilities, such as lighting fixtures, ballasts and the like.

Existing tap connectors are known, that are capable of tapping into an insulated, solid or stranded copper wire midway between the wire ends, without cutting or stripping the wire at the tap-in point. A conductor may be joined at the tap point to form a "T" intersection wire termination. Such tap connectors are limited, however, to tapping individual wires along the wire route, requiring the installer to make multiple individual taps. Wiring installations, e.g., lighting or control wiring, frequently involve multiple wires routed together through raceways or wire harnesses, such that installation of midway taps requires laborious, time-consuming tap connections to be made.

These and other drawbacks are found in current connector systems.

What is needed is a connector that overcomes these and other drawbacks by allowing multiple midway taps to be made simultaneously in the middle of a multiple wire run.

SUMMARY

An electrical connector assembly includes a first connector portion for supporting a plurality of insulated electrical conductors having an exterior insulating layer surrounding a conductive core portion. The first connector portion also includes a plurality of detent elements to secure the plurality of electrical conductors to the first connector portion, and at least one alignment recess. A second connector portion is removably engageable with the first connector portion. The second connector portion includes a plurality of socket portions corresponding to the plurality of electrical conductors of the first portion, and an alignment member cooperative with the alignment recess to guide the second connector portion into engagement with the first connector portion. Socket portions include an insulation displacement crimp (IDC) connector portion configured to penetrate a corresponding external insulating layer of a corresponding one of the plurality of electrical conductors to place the IDC connector portion in electrical communication with the conductive core portion of the corresponding electrical conductor.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
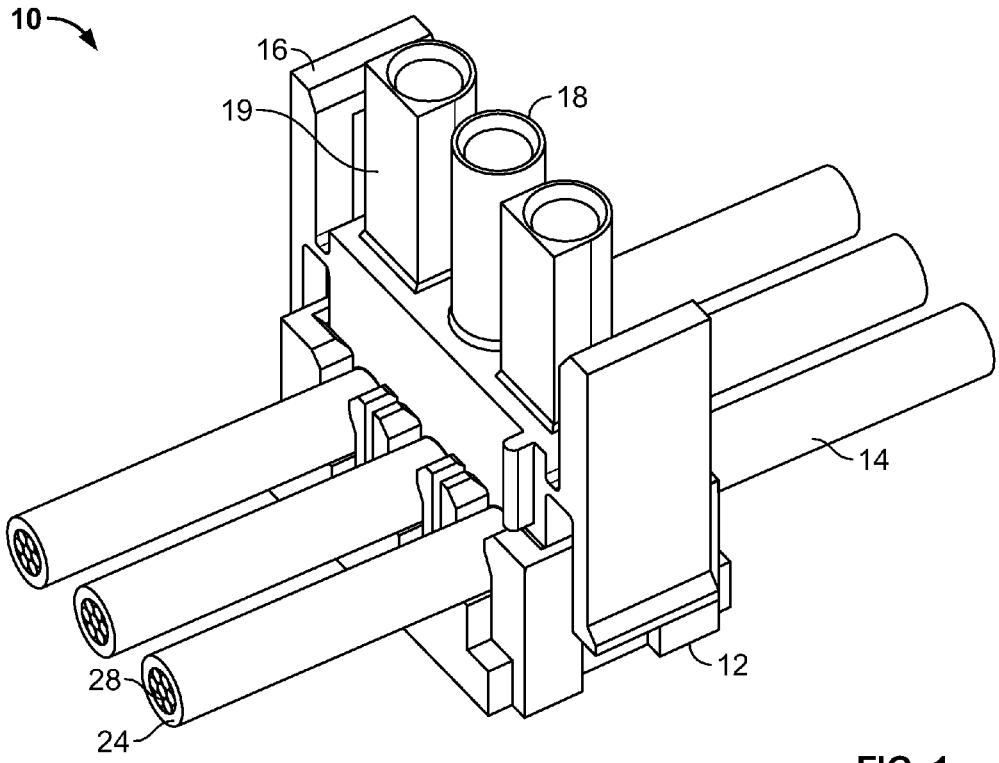
FIG. 1 is a perspective view of a connector assembly in accordance with an exemplary embodiment.
Figure 2:
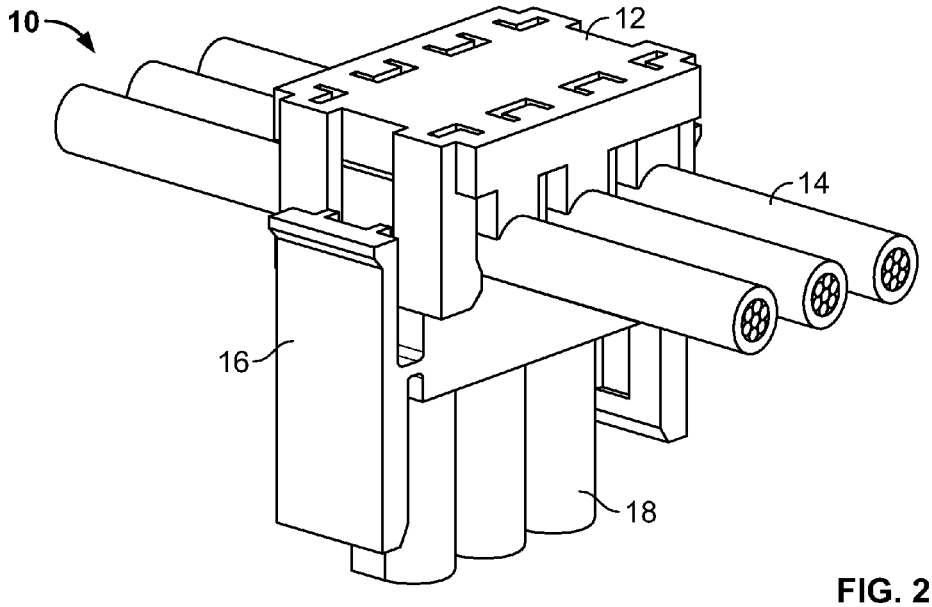
FIG. 2 is an alternate perspective view of the connector assembly.
Figure 3:
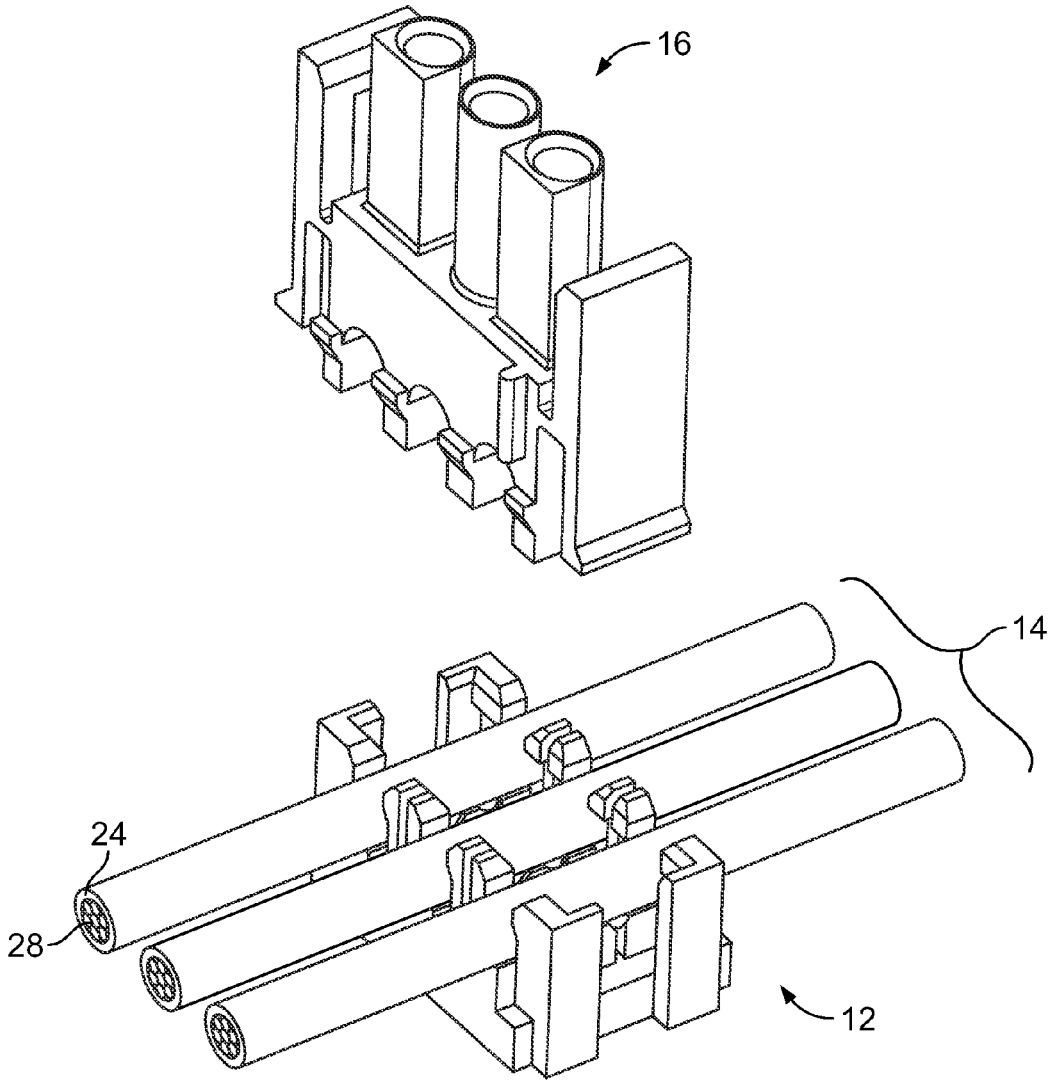
FIG. 3 is an exploded view showing the separate connector parts, and wires laced in the termination block.

Referring to FIGS. 1-3, an exemplary embodiment of a connector assembly is illustrated. In the exemplary embodiment, there are three wires shown. However, as will be understood by those skilled in the art, that the connector assembly may feature more or less wire connections, and while the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims.

A connector assembly 10 includes a termination block 12 that supports multiple insulated conductor wires 14. Wires 14 are laid generally parallel to each other and maintained in alignment for receiving a plug connector body 16. The plug connector body 16 is interlockingly engageable with the termination block 12 to secure the conductor wires 14 in position in the termination block. Multiple socket portions 18 are arranged in the plug connector body 16. As shown, the socket portions 18 extend generally perpendicularly with respect to the wire conductors 14. Alternatively, the socket portions 18 may extend at obtuse or acute angle with respect to the wire conductors 14. In one embodiment the socket portions 18 may also include polarization features, such as flattened side portions 19, to ensure proper alignment of the connector assembly 10 with external connectors. The insulated wire conductors 14 lie in the arcuate troughs 22 (see, e.g., FIG. 5) that support the generally circular outer diameter of the insulated conductor layer 24. For example, the wire conductors 14 may be type TFN or TFFN thermoplastic insulated, nylon sheathed heat, oil & gasoline resistant 600 Volt copper wire.

Figure 4:
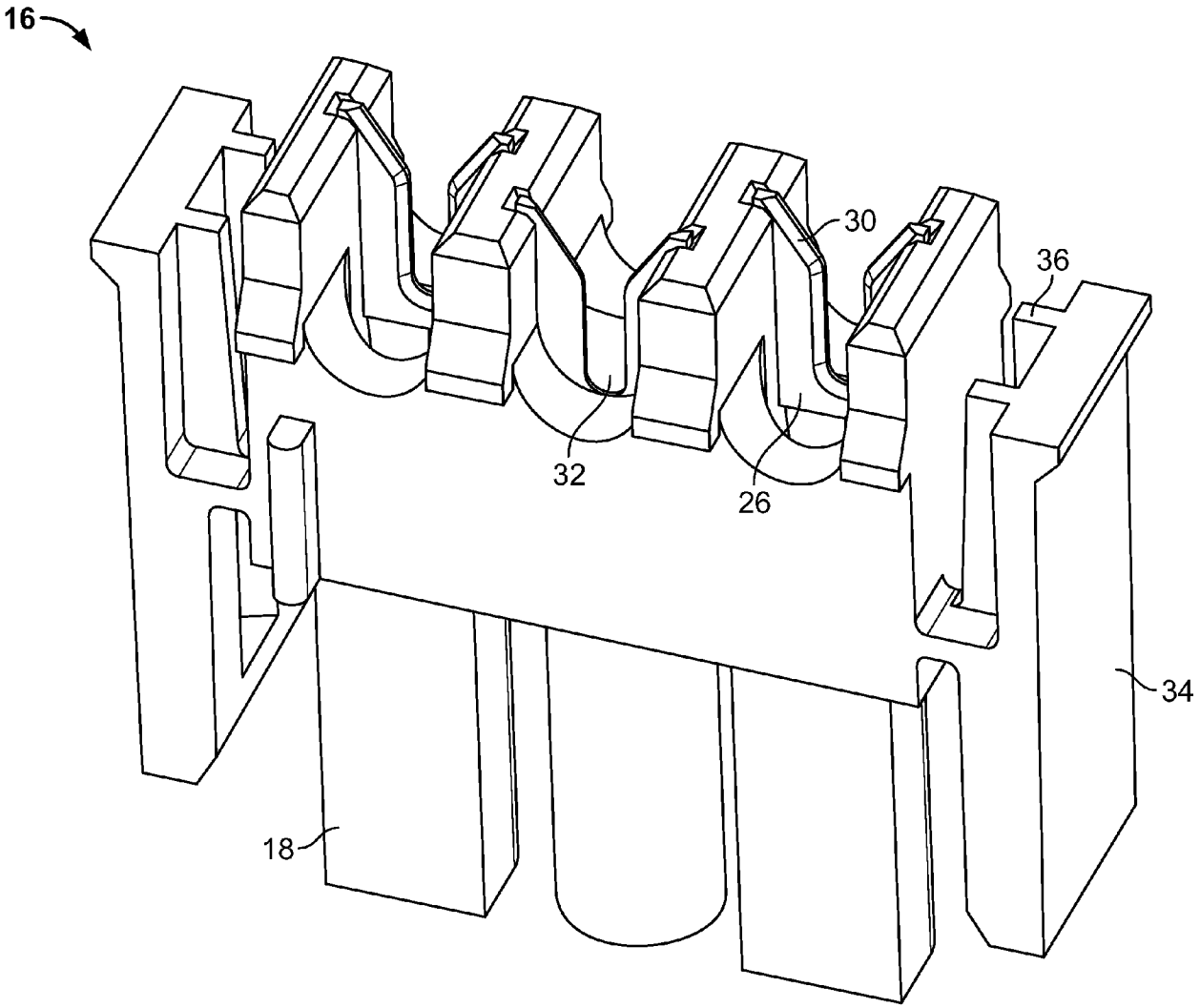
FIG. 4 is a perspective view of the insulation displacement crimp (IDC) connector portion of the connector assembly.
Figure 5:
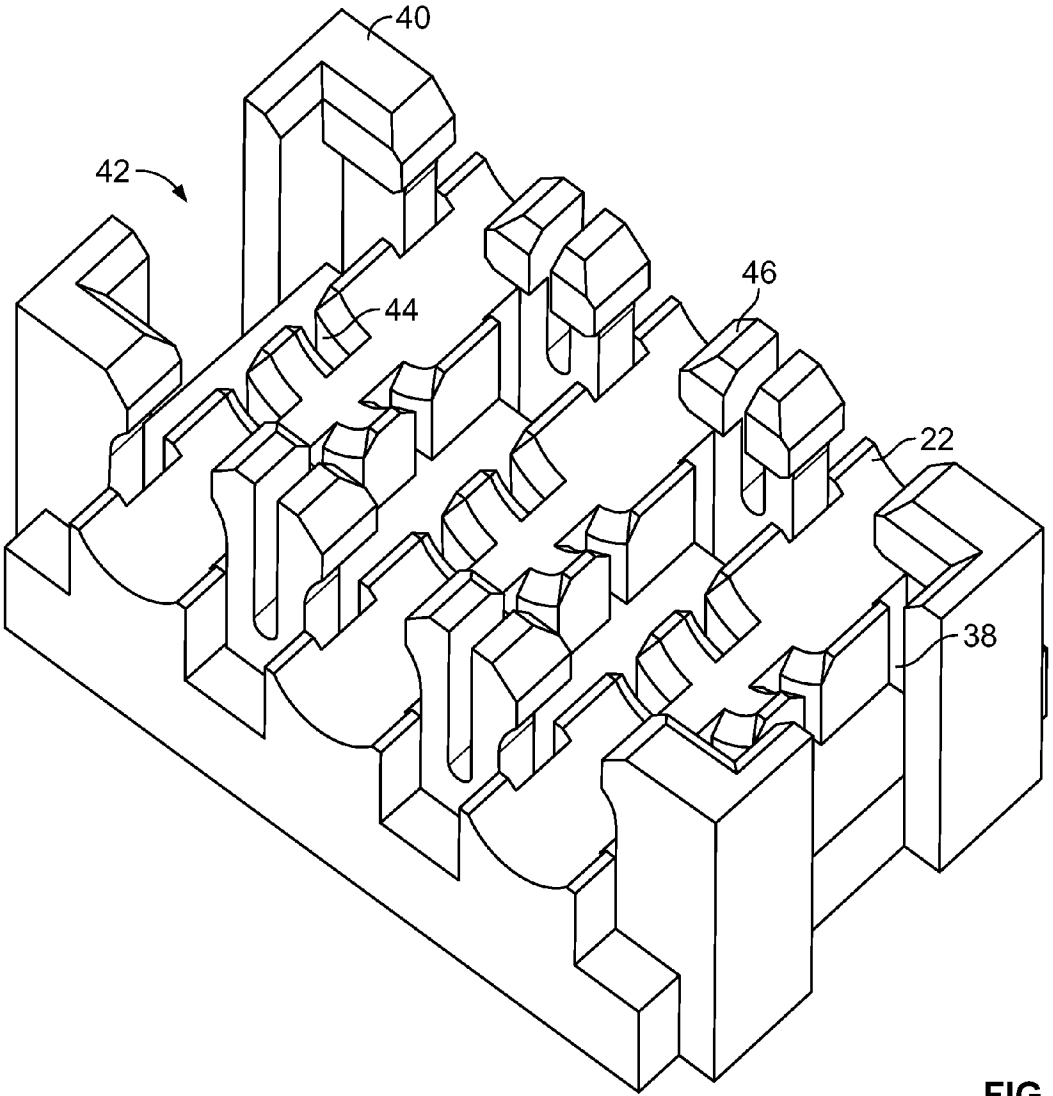
FIG. 5 is a perspective view of the termination block of the connector assembly.

Referring next to FIGS. 4 and 5, once the wires 14 are laid in the troughs 22, the plug connector body 16 is aligned with and compressed or crimped down onto the termination block 12. The compressive force causes the IDCs 26 to penetrate the insulating jacket 24 and make electrical contact with the copper conductor 28. The IDCs 26 are disposed in the socket portions 18 of plug connector body 16. IDCs may include beveled or sharpened edges 30 to enhance the ability of the IDCs to cut into and through the insulating material 24. The IDCs include slots 32 for receiving the copper conductors 28, and making electrical contact therewith. The width of each slot 32 is less than or equal to the outer diameter of the conductors 28 so that the conductors 28 engage in electrical, metal-to-metal contact with edges 30 when the plug connector body 16 is positioned over the termination block 12. The IDCs may be made from tin-plated copper alloy or copper, and the edges may be tin-plated or un-plated copper, although other conductors may also be used.

Referring to FIGS. 2, 4 and 5, the connector assembly 10 includes cooperative alignment elements including at least one alignment recess 42 included on the termination block 12 and at least one alignment member 36 included on the plug connector body 16 to guide the plug connector body 16 into engagement with the termination block 12.

The plug connector body 16 and the termination block 12 may be formed by molding polymeric or polyamide material into the desired shapes. The plug connector body 16 includes latching members 34 on one or both sides, which latch onto a conventional mating printed circuit board (PCB) header (not shown). Also, the IDCs 26 may be staggered laterally in the plug connector body 16. There are corresponding recesses 44 formed on either side of the arcuate troughs 22, for receiving the IDCs 26. In the embodiment of FIG. 5, two sets of recesses 44 are formed adjacent each trough 22 to match the staggered alignment of the IDCs in the mating plug connector body 16, so that the plug connector body 16 may be reversed without interfering with coupling between the plug connector body 16 and the termination block 12. Detent members 46 may be provided on opposite sides and either end of the termination block 12, to clamp around the wire conductors 14 to ensure alignment of the conductors 14 in the troughs 22.

Figure 6:
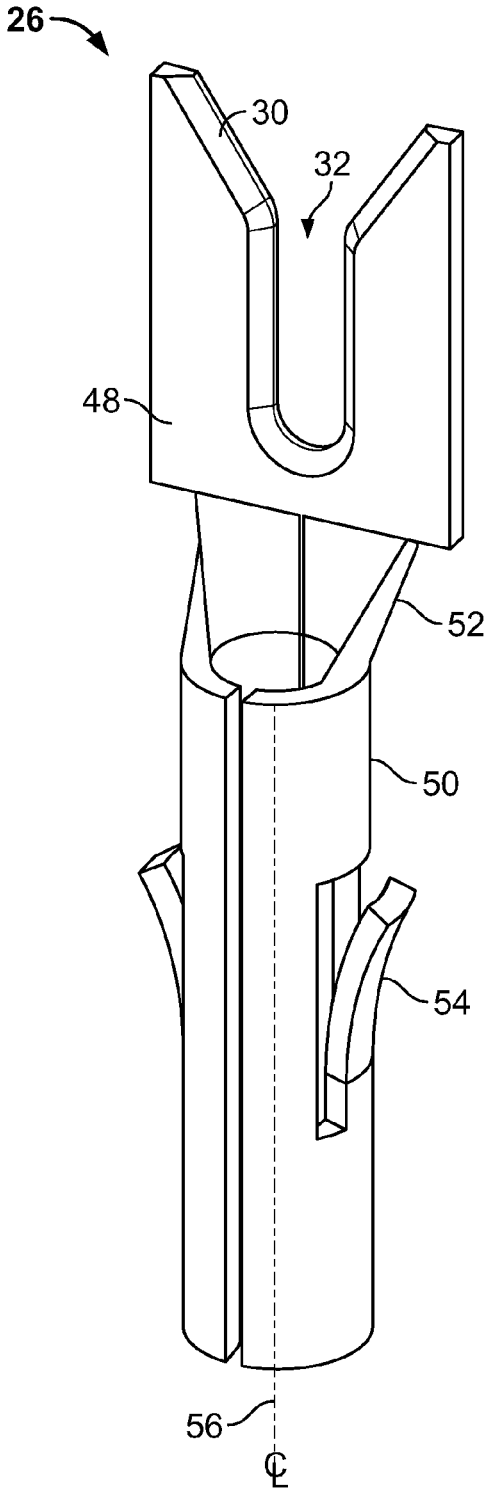
FIG. 6 is a perspective view of an IDC connector portion.

Referring next to FIG. 6, the IDC 26 has a spade-like end portion 48 with edges 30 defining a slot 32, as described above. The end portion 48 is connected to a cylindrical barrel portion 50 by a transition portion 52, for providing electrical continuity from the end portion 48 to the barrel portion 50, for interconnecting with an external electrical connector (not shown). The IDCs 26 are inserted into the electrical insulating material of the sockets 18. The barrel portion 50 has one or more lances 54 extending outward at an angle to the axis 56 of the barrel portion 50. The lances 54 snap into ledges internal to the housing 16 to secure the barrel portion 50 within the socket 18.

Figure 7:
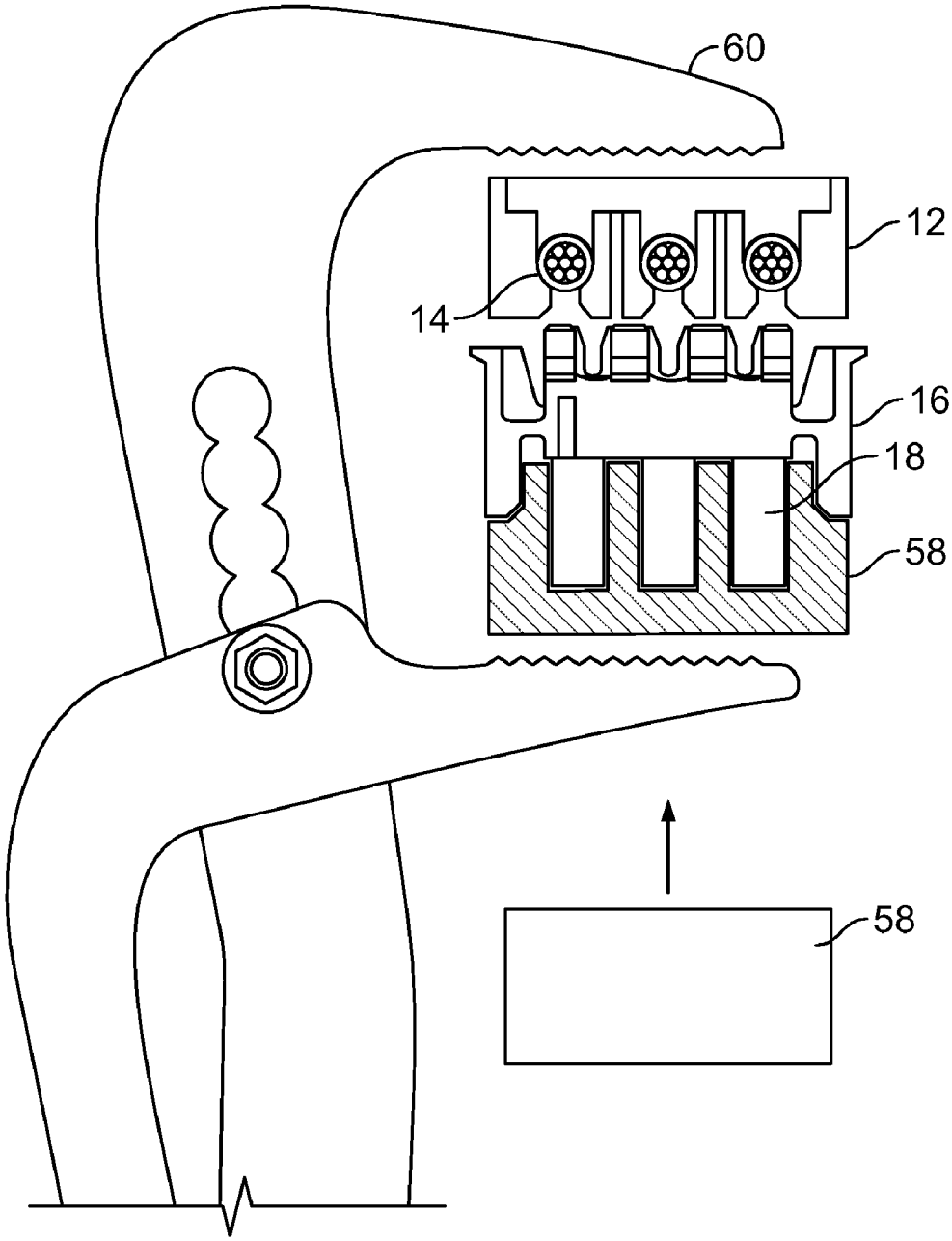
FIG. 7 is a cross-sectional view of a connector assembly and a tool for joining the separate elements of the connector assembly.

Referring next to FIG. 7, an exemplary embodiment is assembled by a tool 60, e.g., Channellok® pliers, to join the termination block 12 with the plug connector body 16. The connector assembly 10 has a disposable cap portion 58 that surrounds the plug connector body 16. The cap portion 58 supports the sockets 18, to prevent the tool 60 from deforming the sockets 18 and the plug connector body 16 when force is applied to join the plug connector body 16 with the termination block 12. When the tool 60 applies crimping force to crimp or compress the plug connector body 16 with the termination block 12 together, the conductors 14 are in electrical communication with the IDCs 26 that are disposed within the sockets 18. The IDCs 26 are arranged to receive external conductors in communication with conductors 14. After the termination block 12 is joined with the plug connector body 16, the cap portion 58 may be discarded to permit an external cable or individual wires to be connected to the sockets 18.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector assembly comprising:

a first connector portion for supporting a plurality of insulated electrical conductors having an exterior insulating layer surrounding a conductive core portion, wherein the first connector portion further includes a plurality of detent elements to secure the plurality of electrical conductors to the first connector portion, and at least one alignment recess;

a second connector portion removably engageable with the first connector portion, the second connector portion having a plurality of socket portions corresponding to the plurality of electrical conductors of the first portion, and at least one alignment member cooperative with the at least one alignment recess of the first connector portion to guide the second connector portion into engagement with the first connector portion;

wherein at least one socket portion of the plurality of socket portions includes at least one insulation displacement crimp (IDC) connector configured to penetrate a corresponding external insulating layer of a corresponding one of the plurality of electrical conductors to place the at least one IDC connector in electrical communication with the conductive core portion of the corresponding electrical conductor;

wherein the first connector portion has a plurality of arcuate troughs disposed between corresponding detent elements for receiving the electrical conductors; and wherein a recess is disposed on each side of each arcuate trough of the plurality of arcuate troughs for receiving the at least one IDC connector;

wherein the plurality of socket portions are integrally molded in the second connector portion, and configured for the socket portions to extend perpendicularly with respect to the plurality of electrical conductors; and wherein at least two of the socket portions have differing geometries for ensuring proper orientation and alignment between the plurality of electrical conductors and an external plug connector.

2. The electrical connector assembly of claim 1, wherein at least one of the socket portion geometries is a D-shaped socket.

3. The electrical connector assembly of claim 1, wherein the arcuate troughs support a generally circular outer diameter insulated conductor layer of the electrical conductors.

4. The electrical connector assembly of claim 1, wherein the second connector portion is configured to receive the electrical conductors in parallel alignment within the first portion.

5. The electrical connector assembly of claim 1, wherein the second connector portion is interlockingly engageable with the first connector portion to secure the electrical conductors in position in the first connector portion.

6. The electrical connector assembly of claim 3, wherein the second connector portion and the first connector portion include cooperating alignment elements, and once the electrical conductors are disposed in the arcuate troughs, the electrical conductors are and compressed or crimped between the second connector portion and the first connector portion so as to cause each of the at least one IDC connector to penetrate the insulating layer surrounding the core portion to make electrical contact therewith.

7. The electrical connector assembly of claim 1, wherein the at least one IDC connector also include beveled edges for penetrating the insulating layer.

8. The electrical connector assembly of claim 7, wherein the at least one IDC connector has slots for receiving the core conductors and making electrical contact therewith.

9. The electrical connector assembly of claim 8, wherein the width of each slot of the at least one IDC connector is less than or equal to the outer diameter of the core conductors, and the core conductors to engage in electrical, metal-to-metal contact with beveled edges when the second connector portion is compressed together with the first connector portion.

10. The electrical connector assembly of claim 1, wherein each of the at least one IDC connector is constructed from a conductive material selected from the group consisting of: tin-plated copper alloy and copper.

11. The electrical connector assembly of claim 6, wherein the beveled edges may be constructed from tin-plated or un-plated copper.

12. The electrical connector assembly of claim 1, wherein the second connector portion having latching members on at least one side, the latching members configured to latch with a conventional mating printed circuit board (PCB) header.

13. The electrical connector assembly of claim 1, wherein the at least one IDC connector is two or more IDC connectors and each of the two or more IDC connectors are staggered with respect to one another in a lateral direction of the second connector portion.

14. The electrical connector assembly of claim 1, also comprising a pair of recesses formed adjacent each trough, and disposed in alignment with the IDCs in the mating second connector portion, to permit the second connector portion to be reversed relative to the first connector portion.

15. The electrical connector assembly of claim 1, also comprising a detachable cap portion disposed over the at least some socket portions, the cap portion configured to transfer a compressive force from the second connector portion to the first connector portion to join the first and second connector portions.

16. The electrical connector assembly of claim 1, wherein the second connector portion also comprises at least one latching member on a side, the at least one latching member latchable with a conventional mating printed circuit board header.

17. The electrical connector assembly of claim 1, wherein the at least one IDC connector includes a plurality of IDC connectors that are staggered laterally with respect to one another in the second connector portion.

18. The electrical connector assembly of claim 1, wherein the first connector portion also comprises opposing recesses adjacent the arcuate troughs to accommodate the at least one IDC connector.

19. The electrical connector assembly of claim 18, wherein two pair of opposing recesses are formed alongside each trough to correspond with the staggered alignment of the at least one IDC connector in the second connector portion, so that the second connector portion may be reversed relative to the first connector portion.

20. The electrical connector assembly of claim 1, also comprising detent members disposed on opposing sides and at either end of the first connector portion, the detent members configured to fit at least partially around the electrical conductors for alignment of the electrical conductors.

21. The electrical connector assembly of claim 1, wherein the at least one IDC connector includes a barrel portion having at least one lance extending outwardly to engage with a ledge within the socket portion to secure the barrel portion within the respective socket.

22. An electrical connector assembly comprising:

a first connector portion for supporting a plurality of insulated electrical conductors having an exterior insulating layer surrounding a conductive core portion, and a second connector portion removably engageable with the first connector portion;

the first connector portion also having a plurality of detent elements to secure the plurality of electrical conductors to the first connector portion, and at least one alignment recess;

the second connector portion having a plurality of socket portions corresponding to the plurality of electrical conductors of the first portion, and at least one alignment member cooperative with the at least one alignment recess to guide the second connector portion into engagement with the first connector portion;

at least some socket portions of the plurality of socket portions include an insulation displacement crimp (IDC) connector portion configured to penetrate a corresponding external insulating layer of a corresponding one of the plurality of electrical conductors to place the IDC connector portion in electrical communication with the conductive core portion of the corresponding electrical conductor; and wherein the plurality of socket portions are configured to extend perpendicularly with respect to the plurality of electrical conductors;

wherein at least two of the socket portions have differing geometries for ensuring proper orientation and alignment between the plurality of electrical conductors and an external plug connector.

* * * * *